US009781971B2

(12) United States Patent
Riddle

(10) Patent No.: US 9,781,971 B2
(45) Date of Patent: Oct. 10, 2017

(54) INTEGRATED MEDICAL SHOE DEVICE

(71) Applicant: Michael Paul Riddle, Hurricane, WV (US)

(72) Inventor: Michael Paul Riddle, Hurricane, WV (US)

( * ) Notice: Subject to any disclaimer, the term of this patent is extended or adjusted under 35 U.S.C. 154(b) by 56 days.

(21) Appl. No.: 14/631,920

(22) Filed: Feb. 26, 2015

(65) Prior Publication Data

US 2015/0196086 A1 Jul. 16, 2015

Related U.S. Application Data

(63) Continuation-in-part of application No. 13/233,181, filed on Sep. 15, 2011, now abandoned.

(51) Int. Cl.

| | |
|---|---|
| ***A43B 7/14*** | (2006.01) |
| ***A43B 13/20*** | (2006.01) |
| ***A43B 13/14*** | (2006.01) |
| ***A43B 7/24*** | (2006.01) |
| ***A43B 17/02*** | (2006.01) |

(52) U.S. Cl.

CPC ..... *A43B 13/20* (2013.01); *A43B 7/142* (2013.01); *A43B 7/143* (2013.01); *A43B 7/144* (2013.01); *A43B 7/1415* (2013.01); *A43B 7/1435* (2013.01); *A43B 7/1465* (2013.01); *A43B 7/24* (2013.01); *A43B 13/143* (2013.01); *A43B 13/148* (2013.01); *A43B 17/023* (2013.01)

(58) Field of Classification Search

CPC ..... A43B 7/143; A43B 7/142; A43B 7/144; A43B 13/148; A43B 21/24

USPC ..... 36/30 R, 34 R, 144, 143, 127

See application file for complete search history.

(56) References Cited

U.S. PATENT DOCUMENTS

| | | | | | |
|---|---|---|---|---|---|
| 1,039,396 | A * | 9/1912 | Hilgert | A43B 7/142 | 36/172 |
| 1,669,987 | A * | 5/1928 | La Chapelle | A43B 13/143 | 12/146 M |
| 2,546,408 | A * | 3/1951 | Riggs | A43B 7/1415 | 36/178 |
| 2,628,440 | A * | 2/1953 | Leydecker | A43B 7/142 | 36/180 |
| 4,180,924 | A * | 1/1980 | Subotnick | A43B 5/06 | 36/104 |

(Continued)

*Primary Examiner* — Ted Kavanaugh

(74) *Attorney, Agent, or Firm* — Timothy Marc Shropshire; Eric Brandon Lovell; Garrett James O'Sullivan

(57) ABSTRACT

This invention generally relates to a shoe in which an orthopedic adjustment has been integrated into the construction of the shoe itself. The invention entails adjusting one or more of the soles or other construction features of the shoe itself in order to accommodate a medical condition or treatment regimen. In particular, in instances of abnormalities in the knee joint, there is a need to redistribute the weight of the body from an afflicted symptomatic medial compartment of the knee to an un-afflicted and asymptomatic, or lesser effected and less symptomatic compartment so as to relieve the pain and stress at the most afflicted and most symptomatic compartment. Benefits are also achieved by reducing a common ankle injury, and by improving lateral cutting, cornering, and push off maneuvers. The present invention achieves all this by laterally wedging the sole of a shoe, where the angle is chosen to counter and redistribute the weight of the body accordingly thereby changing the axial load on the knee and ankle joints.

6 Claims, 6 Drawing Sheets

(56) References Cited

U.S. PATENT DOCUMENTS

| | | | | | |
|---|---|---|---|---|---|
| 4,578,882 | A * | 4/1986 | Talarico, II | A43B 13/14 | 36/103 |
| 4,620,376 | A * | 11/1986 | Talarico, II | A43B 7/14 | 36/103 |
| 4,862,605 | A * | 9/1989 | Gardner | A43B 13/38 | 36/43 |
| 6,725,578 | B2 * | 4/2004 | Kerrigan | A43B 7/142 | 36/144 |
| 7,464,428 | B2 * | 12/2008 | Norton | A43B 13/04 | 12/142 R |
| 9,603,412 | B2 * | 3/2017 | Adair | A43B 13/148 | |
| 2002/0005000 | A1 * | 1/2002 | Choi | A43B 7/1435 | 36/144 |

* cited by examiner

INTEGRATED MEDICAL SHOE DEVICE

CROSS REFERENCE TO RELATED APPLICATIONS

This application is a continuation-in-part of, and claims priority and benefit to, U.S. non-provisional patent application Ser. No. 13/233,181, filed Sep. 15, 2011, entitled "Integrated Medical Shoe Device", now abandoned, the entire disclosure of which is incorporated by reference herein.

BACKGROUND OF THE INVENTION (a) Technical Field of the Invention

This invention generally relates to a shoe in which an orthopedic adjustment has been integrated into the construction of the shoe itself. More specifically, the invention entails; adjusting one or more of the soles or other construction features of the shoe itself in order to accommodate a medical condition or treatment regimen.

The shoe substrate has a direct impact on the knee and ankle joints. A knee joint has three compartments—an inner, medial femorotibial compartment; an outer, lateral femorotibial compartment; and a frontal, anterior femoropatellar compartment. A normal knee joint has collateral ligaments that strap together the medial and lateral sides of the joint and cruciate ligaments that provide crossing within the joint. Together, these ligaments stabilize and strengthen the knee.

Within the knee joint there are two types of joint cartilage: fibrous cartilage (the meniscus) and hyaline cartilage. Cartilage is a thin, elastic tissue that protects the bone and makes certain that the joint surfaces can slide easily over each other ensuring smooth painless knee movement. The meniscus has tensile strength and can resist pressure essentially acting as a shock absorber. The hyaline cartilage covers the surface along which the joints move. In addition, the joint is lubricated by a fluid produced by the synovial membrane. The meniscus serves to distribute the load of the body evenly, and also aids in disbursing this synovial fluid for joint lubrication.

There are two primary ways in which the knee joint may lose its normal functionality—traumatic injury or age related degeneration. Consequently, depending on the degree of a traumatic injury and what part of the knee was injured, the injury itself may lead to post traumatic degeneration. In either case the cartilage inevitably will wear over time and has a very limited capacity for self-restoration. Any newly formed tissue will generally consist of a fibrous cartilage of a lesser quality than the original hyaline cartilage. As a result, new cracks and tears will continue to form in the cartilage progressively causing inflammation and a loss of lubrication from reduced or lost synovial fluid. In turn this then leads to varying degrees of knee pain that is proportional to the degree of degeneration.

Among the more common traumatic knee injuries that lead to degeneration of the knee joint would be a meniscal tear, an anterior cruciate ligament ("ACL") tear, or an intra-articular bone fracture. The first two are often seen in sports related injuries. The intra-articular bone fracture conversely is usually seen in hard falls and motor vehicle accidents. In this type of injury, the break crosses through and negatively affects the smooth surfaces of the involved articulating cartilage.

As joint degeneration progresses, so comes the development of osteoarthritis. This in essence is caused by the general wear and tear of the joint. As the hyaline cartilage and the meniscus break down and wear away, this causes the bones to rub together, causing pain, swelling, and stiffness. Bony spurs or extra bones may also form around the joint, and the ligaments and muscles around the knee become weaker.

The biomechanical aspects of gait and impact alignment have been medically recognized. It is well-known and well documented that improved alignment and altering the dynamic forces on the relevant compartment in the knees can significantly alleviate the symptoms, reduce and slow disease progression, and in some cases, allow the joint to heal to some degree. In this respect, well-known biomechanical and clinical studies have established the usefulness of a lateral wedge in reducing the load on the medial knee compartment.

The present invention is generally directed at various uses and positions of a wedge angle to alleviate symptoms of pain at the knee joints, especially knee pain associated with degenerative joint disease, to slow the progression of degenerative joint disease in the knee, and to help prevent premature degeneration of the knee joints in susceptible persons. The wedge angle is integrated into the design of the shoe's sole, thereby not interfering with the normal functionality, safety, fit, or comfort of a shoe. This contrasts with the majority of current practice and prior-art devices wherein adjustments to shoes are made to only portions of the sole, or by a double taper, or by means of an insert, an external attachment, or other devices worn by a user in addition to the shoe.

In this invention primarily, it is the shoe sole construction and design itself that is being modified to accommodate some orthopedic goal which has been medically prescribed. In this sense, the shoe would be custom-made to accommodate the orthopedic condition being treated, accommodated, or prevented. However, stating that this shoe would be custom-made, does not mean that it would be custom-made for each individual and or further adjusted in a trial and error fashion like a great many of the prior-art. Rather, it would be custom-made in its unique and novel fabrication and design, but would be universal in its application for all persons regardless of their individual symptoms and degree of their orthopedic condition.

(b) Description of the Relevant Art

A considerable number of patents relate generally to adjusting a shoe to accommodate a medical condition by the wearer. Many of these inventions take the form of an insert, or external device added or attached to the shoe, and some feature integrated adjustments.

In U.S. Pat. No. 6,205,685 B1, Kellerman discloses an adjustable orthotic insole to be used for therapeutic adjustment, and which is customized to the user. The Kellerman insole can be modified by the user such as to adjust elevated areas within the orthotic insert and relieve areas of pressure on the foot, much like an orthotic insert. By trial and error placement of pads of varying thicknesses on the bottom surface, the user can create a customized therapeutic device capable of relieving pain and stress. The trial and error method of adding and removing pads appears to be the primary essence of the invention. The Kellerman specification does state that expert alignment can be provided by a doctor adjusting the pads to correct particular misalignments or problems with the feet.

Kellerman states that an infinite number of adjustment features can be included and that the custom shape of his invention can be a permanently prescribed orthotic, or it can be a temporary device used until a permanent orthotic is fabricated. The Kellerman device begins with a base insert comprised of a non-compressible sheet of flexible but deformable material in the range of 10 to 100 mils in thickness. Vinyl resin, polyethylene and polypropylene are all identified as optimum materials for the base. The base material is attached to the inside of the shoe in a variety of ways, including the use of Velcro and other commercial loop materials.

U.S. Pat. No. 5,138,774 by Sarkosi is similar to the Kellerman invention in many respects. However, Sarkosi attempts to set forth an adjustable shoe insole for providing therapeutic relief by including an assortment of thin, removable, stackable support pads. In essence, the user is enabled to stack a series of small pads onto various regions of the insole in order to build up support in particular areas as required for greater comfort. Sarkosi states that by choosing specific materials set forth in the patent, and constructing the pads to be thin, the result is an insole that is non-skid such that it stays appropriately in place when stacked. The adjustable pads are not sewed or glued together, and additional pads may be added, and pads removed over time, as needed. In this sense, the Sarkosi invention is essentially the use of inserts comprised of thin, stackable comfort pads in a shoe insole.

U.S. Pat. No. 4,841,648 by Shaffer, et al. is directed to a personalized insole kit for a shoe. The basic idea behind this patent is to develop an insole kit comprised of a collection of specific foot regions, each of which can be modified for a specific therapeutic effect. The thrust of this patent is also directed to a shoe insole kit that can be modified and adjusted by the end-user consumer. The summary section states that the Shaffer article is a personalized insole self-made by the patient for relief of foot discomfort, including a plurality of corrective components, each having a shape formed for a specific correction. The six primary adjustment regions identified in the application include an arch pad, a heel pad, a metatarsal pad, a lesion pad and others. The various regional components assemble together to form the general outline of the insole. The claims of the patent are all directed to a device defined by a plurality of removable and replaceable corrective components which are to be personalized for comfort by the end-user.

Another patent similar to Shaffer is U.S. Pat. No. 4,633,877 by Pendergast. This patent also sets forth an orthopedic insole component which is to be added to the interior of a shoe for a therapeutic effect. As with Shaffer, Pendergast also divides the insole into specific and discreet regions. All of the Pendergast segments are of the same thickness such that when assembled, the device will be "flat" from side to side and from posterior to anterior. However, although the overall device is of the same thickness, the various segments are constructed such that they are each made from materials having a predetermined range of firmness. Each of the specific regions has its own durometer selected from one of a group of ranges of durometers set forth in the patent. Accordingly, the various insole regions have a different hardness, which can be selected for specific desired therapeutic effect. The Pendergast invention is an insert article as opposed to an integrated shoe sole custom-designed for a particular effect.

U.S. Pat. No. 5,042,175 by Ronen is titled "User-Specific Shoe Sole Coil Spring System and Method". The Ronen device is a user-specific shoe sole that is customized to the individual to achieve a specific orthopedic goal. The customized shoe sole of Ronen is achieved by a specific coil spring construction. The coil spring system layout and stiffness characteristic may be customized to serve the needs of different users and different applications. A user's weight and particular comfort and/or orthopedic requirements are met by fitting the sole with a greater or lesser quantity of springs with different levels of stiffness. Ronen states that the result is a shock-absorbing distribution pattern that suits the requirement of a particular application. All of the Ronen claims are limited to the coil spring element.

U.S. Pat. No. 4,756,096 by Meyer is directed to a custom-molded insert for footwear, and the patent is more particularly directed to an insert to be used with ski boots. The Meyer insole is a one-piece, thin, contoured blank of semi-rigid, bendable, resilient material molded such as to include the complete detail of the full plantar surface of the foot. As such, the Meyer insole provides a four-point contact with a supporting surface of the footwear at the heel, great toe, and at least two, spaced metatarsal heads. According to the inventor, this arrangement provides natural balance and a proper dynamic positioning of the foot and immediate energy transfer between the foot and the footwear, such as a boot or ski. In essence, the problem Meyer is attempting to address is the fact that looseness, or sloppiness, inside a ski boot can lead to loss of control, or rubbing, or other repetitive stress injuries to the feet. The claims are all limited to a one-piece insert that is constructed such as to mold closely to the foot. Meyer does not address customizing a shoe for a therapeutic effect.

U.S. Pat. No. 5,014,706 by Philipp is titled "Orthotic Insole with Regions of Different Hardness". With this invention, the title of the patent says it all. As shown in FIGS. 1 through 6 of the patent, regions of the insole may be selected to have different hardnesses by altering the type of material used to comprise that portion of the insole. The regions which are specifically defined in the drawings are selected by the inventor to be those areas in which a particular therapeutic adjustment may be needed for some users. Each of the regions of the insole is constructed of a deformable material, but a particular durometer, or hardness, is assigned to each of the regions as needed. The claims of the patent are all directed to specified regions of differing hardnesses.

U.S. Pat. No. 4,813,157 by Boisvert, et al. is another variation of adjustable shoe insole wherein a plurality of adjustable thickness layers are used to build up certain regions of the insole. Boisvert states that the insole comprises superimposed pad layers made of a flexible material for the top layers and a cork material for the remaining pad layers. This patent states that a pressure adhesive, such as hot-melt glue, could be used to releasably interconnect the superimposed pad layers in order to allow repeated peel-off removal and reconnection of the layers. The patent consists of a single, independent claim and thirteen dependent claims, and the feature of multiple layers of support which may be peeled off and reapplied is a required feature of all of the claims.

U.S. Pat. No. 2,909,854 by Edelstein is an older patent directed to pressure-relieving insoles. As shown in the drawing, Edelstein accomplishes the goal of relieving pressure by having a cut-away portion of the insole. The aperture areas of the insole are used to provide relief, and the inventor specifically notes the relief of calluses by enabling the callused area to extend into the aperture such as to relieve walking pressure on the callus.

U.S. Pat. No. 4,620,376 by Talarico is a patent limited to "forefoot valgus compensation." Although his shoe sole has a lateral wedge, it is restricted primarily to the forefoot only, and does not encompass the entire span of the lateral side from front to back. It does not incorporate the heel, or the midfoot. Furthermore this invention is a two directional wedge. Although there is a lateral wedge (distal forefoot only), it does not maintain a height and thickness that is substantially the same from front to back on the lateral side. The sole in Talarico's invention is longitudinally beveled downward from back to front whereby the rear of the forefoot compensation is higher than the front of the forefoot compensation. This longitudinal bevel by default will simultaneously cause a progressively decreasing lateral wedge angle moving from the rear of the forefoot compensation to the front of the forefoot compensation. By design his invention is limited in its application to only 5% of the general population with this "foot" deformity, and does not address ailments of the knees.

U.S. Pat. No. 6,725,578 by Kerrigan similar to Talarico provides a laterally wedged shoe sole but goes further to include and compensate not just the forefoot, but also the heel. Although Kerrigan goes further than Talarico to include the heel, this invention is still limited because it also does not encompass a lateral wedge that spans the entire lateral side from front to back, but rather it is wedged only at the heel and forefoot and in a multidirectional fashion. In addition it has a cantilever medial arch support at a raised height on the medial side. By design it does not incorporate or compensate a lateral wedge at the midfoot or toes purposely to attempt to "reduce the peak knee varus torque and hip adductor torque values in early and late stance during walking and running."

U.S. Pat. No. 4,862,605 by Gardner is an inner sole with a lateral wedge similar to Talarico and Kerrigan but it takes it further to allow the wedge to include the span from the heel to the toes. But like that of Talarico and Kerrigan, it is also a two directional wedge. Although this has a lateral wedge, it too does not maintain a height and thickness that is substantially the same from front to back on the lateral side. The inner sole in this Gardner invention is also longitudinally beveled, tapering downward from heel to the toes, from back to front, whereby the rear of the heel compensation is higher than the front of the toes compensation. This is essentially the same effect as that of a heel lift. In addition, this longitudinal bevel by default will simultaneously cause a progressively decreasing lateral wedge angle moving from back to front. Furthermore it must be noted that the heel area is several degrees lower than the portion running from the heel area longitudinally to the toe area. This is in theory an attempt to present a "condition whereby the calcaneum or heel bone will strike a more natural and uniform plane as the foot starts to pronate, thereby presenting a more stable function of the foot."

The patents mentioned above, and other prior-art devices, fail to adequately solve the problems associated with painful or arthritic knees. The prior-art devices fall into four broad categories—those that attach an external corrective material to the outsole or bottom of the shoe, those that add an insert inside the shoe, those that might chemically engineer the soles in their fabrication to have a variability of durometry or hardness, and those that wedge only a portion of the sole or have a two directional taper.

In the first category, external corrective materials, wedged or otherwise, that are attached to the outsole or bottom of the shoe are especially wrought with problems. The least of these problems would be that the overall comfort and feel of the shoe would be changed by adding something foreign. More so, any external attachment will also change the height of the shoe sole. This height increase will be directly transferred to the entire leg. If used on only one shoe, this will increase the overall leg length compared to the opposing side. The effect would be that of a leg length discrepancy. The result will be an awkward gait, a pelvic shift, and undue stress or discomfort over time referred to the hip and spine.

In addition, external attachments may not be universal for all types of shoes, meaning they may not fit all shoes and tread patterns. For the shoes they do fit, the degree of fit may vary greatly by the shoe. These can be difficult to apply and in some instances it may require much trial and error, and adjustment by the wearer, or a medical provider. They are not universal to the patient or the degree of arthritis either.

Most importantly however, these external attachments may actually be dangerous for the wearer. Since they are attached to the outside of the shoe, they are not part of the shoe. By raising the height of the shoe from the ground, this changes the center of gravity and stability of the shoe potentially leading to balance issues, falls, and foot, ankle or other injury. Because shoe tread contacts the ground, any attachments to the bottom of a shoe are going to be prone to getting caught on obstacles or uneven walking surfaces during ambulation as well. Furthermore, if the attachment becomes loose, this will increase this risk and or the device may just fall off. Another important danger is that external materials change the traction of the shoe because it will cover all or a portion of the shoe's natural tread. Essentially any external attachment to a shoe is a danger to the wearer for these reasons, and can potentially cause a person to fall leading to serious injury. Most of these external attachments are not custom made to the individual shoes either. By default, given the countless shoes in existence, this makes their compatibility and fit highly variable and primitive at best.

In the second category, those that add an additional insole or insert, wedged or otherwise, inside the shoe, are wrought with problems as well. By default these are additions to existing shoes that are placed on or attached to the native insole inside the shoe instead of to the outsole outside the shoe. Shoe inserts of all types are likely as numerous as there are shoes. Most are very similar and claim to aid in some ailment. These types of orthotics in majority are primarily for foot ailments and rarely for the knee or ankle ailments. Even for any that may have a lateral wedge, it is typically limited to the heel, the wedge does not traverse the span on the lateral side, and the wedge is not at the same thickness front to back. Furthermore, when adding inserts into an existing shoe, this will decrease the inside height and space of the shoe box that is available for the foot. This significantly changes the overall fit and feel of the shoe. Frequently, this will cause the need to loosen the shoe laces to accommodate the loss of foot space. Simultaneously, as these inserts decrease the height inside the shoe, they will increase the overall height of the shoe sole because they are positioned over the shoe's native insole. This height increase will be directly transferred to the entire leg. If used on only one shoe, this will increase the overall leg length compared to the opposing side. The effect would be that of a leg length discrepancy just as it is with adding an external device to the shoe's native outsole in the prior category. The result will be an awkward gait, a pelvic shift, and undo stress or discomfort over time referred to the hip and spine. In situations where inserts cover the shoe's entire native insole, they must be cut and adjusted in accordance with the size of the wearer's foot, the size of the shoe's native insole over which they will be placed, and the amount of available interior shoe space. If the type of inserts that is being used does not cover the shoe's entire native insole, they must either sit freely inside the shoe or be adhered to the inside of the shoe. This makes position placement and maintenance of that position very problematic as well.

With both types of inserts, those that cover the shoe's entire native insole and those that do not, they frequently tend to slide around changing positions within the shoes. This causes the burdensome and continual need for the inserts to be repositioned or replaced. In general when using any inserts, the need for sizing, placement, positioning, and maintenance is very cumbersome and time consuming. Their use will usually require much trial and error and adjustments. Although inserts can be made somewhat universal to the shoe, it's only after this tedious modification by the patient or healthcare provider. More importantly however are the potential risks associated with their use. By raising the height of the foot from the ground as it sits on the added insert, this too, as with the first category, changes the center of gravity and stability of the shoe potentially leading to balance issues, falls, and foot, ankle or other injury. Furthermore, any insert, being foreign to a prefabricated shoe that makes direct contact with a wearer's foot can cause pressure points, friction blisters, or skin breakdown. This is particularly dangerous to wearer's who have healing or vascular compromise, or peripheral neuropathy due to Diabetes Mellitus, Peripheral Vascular Disease, or immunocompromise. These persons are at a much higher risk for developments of skin ulcerations leading to severe infections that can lead to a need for amputations. If the inserts are cut or sized inappropriately, this can increase these risks and cause further discomfort by uneven contours, and pressure points against the foot inside the shoe.

In the third category, those that might chemically engineer the soles in their fabrication to have a variability of durometry or hardness, also have a host of problems. Although the fit and feel of the shoe may not be grossly affected, it greatly affects the overall durability and performance of the shoe. By changing the chemical makeup of the sole itself in this way, although a wedge effect may occur after weight and pressure is applied causing it to compress more on the softer portion, this changes the wear ability of the shoe and the tread. The softer less firm side will wear out much faster, and the harder firmer side by default will wear out more slowly. So ultimately uneven tread wear increased on the softer side of the sole will cause the wedge effect to increase and not remain constant or therapeutic. This causes the desired corrective measure to become less effective and can potentially cause knee, foot, and ankle pain to increase proportionally as the angle increases out of the desired therapeutic range. Moreover, as the shoes wear out quickly, they would need to be replaced, adding unnecessary cost to the therapeutic process.

These shoes would likely be more expensive than the normal shoe also because of the complex chemical engineering that must be used during fabrication. For that matter, if any of the other two categories were custom made to the individual, the cost would rise significantly as well. Most importantly however with this third category are the risks and dangers to the wearer associated with the varying sole hardness and the uneven tread wear. Firstly, during normal ambulation, stability of gait is determined greatly by the expected plantar of equal durometry against the bottom of the foot transferred to the ankle medial to lateral. By having unequal durometry with one side of the sole more or less firm than the other side, this creates a problem for the foot and ankle to compensate especially during ambulation over uneven surfaces. This can lead to foot and ankle injury, or even falls resulting in further more serious injury. Furthermore, the durometry and wear-ability directly affects the grip and traction of the shoe's outsoles. The softer side will have much more grip and traction prior to it wearing out, but decreased wear-ability by default. The harder firmer side, although having greater wearability, by default will have less grip and traction. This can potentially cause loss of traction thereof during ambulation resulting in a fall or serious injury. It is a fact that there is a great population of people with many ailments, particularly involving the knees. As stated, the patents mentioned above, and other prior-art, although they make an attempt, fail to adequately solve the problems associated with painful or arthritic knees and in many cases add additional problems or risks to the equation by their design.

In the fourth category, those that wedge only a portion of the sole, or have an additional heel to toe taper cause problematic issues as well. As noted in the above prior art if the lateral wedge is limited to a portion of the sole, like the forefoot only, for example, then not only does it limit its application to only 5% of the population with a specific foot deformity, but it also creates a significant localized pressure point on the lateral forefoot. Having an unequal localized pressure point can cause skin breakdown on the foot and discomfort. It is particularly risky to use with any patient who may have lower extremity peripheral neuropathy (decreased sensory perception in the feet). If the lateral wedge is limited to the heel and forefoot then the same risks applies above with regards to the pressure points and discomfort, but this also puts a significant amount of stress on the unsupported base and shaft of the $4^{th}$ and $5^{th}$ metatarsals (the bones proximal to the small toes that could lead to stress fractures. Lastly, a lateral wedge that traverses the span on the lateral side but simultaneously is tapering down from the heel to toes (like a prior art that is similar to a heel lift), causes problems as well and is self-defeating by limiting the load transfer. Additionally these double or multidirectional bevel particularly the longitudinal bevel causes a progressively decreasing and varying lateral wedge angle moving from the back of the lateral compensation to the front of the lateral compensation. This type of wedge puts significant stress localized on the anterolateral ankle, and also causes a forced rotation of the lower extremity. Furthermore it causes unequal torque of the foot and doesn't adequately transfer the load uniformly away from the medial knee joint compartment across the anterior and posterior horns. The solution to equal load transfer away from the entire medial knee compartment can be demonstrated by walking barefoot (or with normal uncompensated footwear) and parallel with each respective foot on a ground surface that has a lateral incline. If both feet are walking each parallel on a lateral inclined surface if the angle is steep enough it will feel as if the person is walking with the knees in more of a valgus (knock knee) gait. Although a steep angle would be an extreme example for demonstrative purposes only, this essentially is the hallmark of the preferred embodiment of the present invention. To a much less lateral degree angle of course (almost unperceivable) but equally unloading the entire medial knee joint compartment front to back by fully supporting the lateral feet from heel, midfoot, forefoot and toe combined at the same height or thickness on the lateral side from back to front with a constant lateral wedge angle spanning the entire lateral side longitudinally from back to front. This of course is distinctly different than the aforementioned prior art that have a varying and/or decreasing lateral wedge angle from back to front.

Therefore, there is a great need for a safe, effective, and universal orthopedic adjustment that is integrated into the construction and design of the shoe sole itself, whereby the shoe fits comfortably without altering its performance. The lateral wedge angle must traverse the entire longitudinal span of the lateral side at a uniformed equal thickness from front to back. The effect would be, as mentioned above, that of someone walking parallel to and on a laterally inclined walking surface (with respect to each foot with or without shoes). This effect, while allowing the foot to be at neutral 90 degree longitudinal angle with respect to the lower leg when standing, pitches each foot and ankle uniformly from back to front into a valgus (lateral wedged angle) position while supporting the entire lateral feet (heel, midfoot, forefoot, and toes) at a constant thickness simultaneously front to back. This then allows for no localized stress or pressure points on the feet or ankles while uniformly transferring the load off the medial knee joint compartment front to back throughout the entire contacted ambulatory range. The present invention solves all these problems and more. It combines or encompasses all the benefits of the prior-art, it enhances and improves the all the benefits of the prior art, but has none of the detriments or drawbacks of the prior-art.

SUMMARY OF THE INVENTION

The present invention provides a unique, safe, effective, and universal orthopedic adjustment that is integrated into the construction and design of the shoe sole itself (may also be in the form of a removable insole), whereby the shoe fits comfortably, without altering its performance. More specifically, the invention entails adjusting one or more layers of the soles (or the entire sole itself if it is a uni-sole with no differing layers), or other construction features of one or more of the shoes themselves in order to accommodate a medical condition or treatment regimen. The present invention is generally directed at creating a lateral wedge angle to alleviate symptoms of knee pain associated with degenerative joint disease, to slow the progression of degenerative joint disease in the knee, and to help prevent premature degeneration of the knee joints in susceptible persons. The invention is applicable to similar considerations at the ankle joints as well. In the preferred embodiment, the wedge angle is integrated into the design of the shoe's sole, thereby not interfering with the normal functionality, safety, fit, or comfort of a shoe. This contrast with the majority of current practice and prior-art wherein adjustments to shoes are made by means of an insert, or an external attachment, or other additional devices worn by a user in addition to the shoe. In this invention, it is the shoe sole construction and designs itself that is being modified to accommodate some orthopedic goal which has been medically prescribed. In this sense, the shoe would be custom-made to accommodate the orthopedic condition being treated, or accommodated, or prevented. However, stating that this shoe would be custom-made, does not mean that it would have to be custom-made for each individual and or further adjusted in a trial and error fashion like a great many of the prior-art. Rather it means that it would be custom-made in its unique and novel fabrication and design, but would be universal in its application for all persons regardless of their individual symptoms and degree of their orthopedic condition.

The preferred embodiment of the invention is directed primarily to the treatment of knee pain related to knee joint degeneration and/or arthritis in all stages. In a person with normal knees, the load is equally distributed between the medial and lateral compartments of each knee. However, in the presence of the targeted congenital or acquired knee deformity known as varus (bow leg), this distribution is skewed. Therefore, the weight load needs to be redistributed lest premature or further progressive joint degeneration will occur. This may be achieved by pitching the feet and ankles at an appropriate lateral wedge angle. The sole would rise from the medial side to the lateral side where the lateral side would be at a greater height and thickness than the medial side. The lateral wedge would traverse the entire span on the lateral side from the heel to the toes at substantially the same constant height and thickness from back to front having a constant lateral wedge angle from back to front. This allows for complete support on the lateral side of the foot to include the heel, midfoot, forefoot, and toes and uniformed load distribution (unloading) away from the medial knee compartment from back to front. It is to be understood that there is no taper from back to front in the compensation of the sole. The only taper is from medial to lateral. The sole may follow the contour of the shoe with or without curves in any direction but the greater thickness on the lateral side remains constant traversing the entire spanning longitudinal length from back to front. The lesser thickness on the medial side remains constant traversing the entire spanning longitudinal length from back to front, although the thickness of any part of the medial side in some embodiments may vary (causing a varying lateral wedge angle longitudinally) so long as all parts along the entire spanning longitudinal length of the medial side remain at a lesser thickness than that of the opposing lateral side along its entire longitudinal length from back to front.

In the present invention, during a shoe's construction and design, as part of the standard sole, the normal angulation would be modified to have an alternate predetermined desired and suitable lateral pitch wedge angulation. In one embodiment, the angled or wedged portion of the sole will be the midsole. This is the body of the sole being the layer traversing the entire span from, back to front and side to side, between the cushioned upper layer or insole, and the treaded lower layer or outsole. In this way, the tread, traction and grip remains unchanged, there are no inserts or attachments, and the pitch is integrated into the construction of the shoe itself. The lateral pitch wedge is integrated into the construction of the shoe itself and rises from the medial side to the lateral side. The lateral side is at a greater height and thickness than the medial side from back to front. The lateral side has a substantially uniformed thickness from back to front on the lateral side. Different layers of the sole may be fabricated with a lateral pitch wedge angle to accommodate various conditions, leading to greater control over the redistribution of the load within the compartments of the knee joint, or at the ankle joint.

In one embodiment, the angled or wedged portion of the sole will be the outsole. This is the bottom treaded layer of the sole traversing the entire span from, back to front and side to side, below the midsole. The lateral pitch wedge is integrated into the construction of the shoe itself and rises from the medial side to the lateral side. The lateral side is at a greater height and thickness than the medial side from back to front. The lateral side has a substantially uniformed thickness from back to front on the lateral side.

In one embodiment, the angled or wedged portion of the sole will be the insole. This is the top layer of the sole traversing the entire span from, back to front and side to side, above the midsole. The lateral pitch wedge is integrated into the construction of the shoe itself and rises from the medial side to the lateral side. The lateral side is at a greater height and thickness than the medial side from back to front. The lateral side has a substantially uniformed thickness from back to front on the lateral side.

In one embodiment, the angled or wedged portion will be a removable insole or shoe insert. This would be a layer inserted or added to the inside of the shoe traversing the entire span from, back to front and side to side, placed or laid on top of the native fixed insole or insole pad. This layer can be free of attachment to the inside of the shoe or can be adhered to the inside of the shoe by an adhesive backing, sewn in, or by other means of fixation. The lateral pitch wedge rises from the medial side to the lateral side. The lateral side is at a greater height and thickness than the medial side from back to front. The lateral side has a substantially uniformed thickness from back to front on the lateral side.

It should be noted that in all the embodiments, the lateral wedge angle, is greater than zero degrees, and slopes from the entire span of the medial side of the sole across to the entire span of the lateral side of the sole although one embodiment may have the lateral wedge angle sloping and compensating the lateral side only though this will ultimately pitch the entire sole from medial to lateral. The height and thickness of said sole is greater on the lateral side than on the medial side. The greater thickness on the lateral side, spanning the entire length of the sole, is the same height or thickness from front to back on the lateral side. The lesser thickness on the medial side, spans the entire length of the sole from front to back on the medial side. The lateral wedge angle of the sole supports the entire span of the lateral load bearing surface of the foot, from the front to back, including the heel, midfoot, forefoot, and toes combined, (although lateral wedge for the toes portion does not have to be included in the combination, it is preferred to be included for the complete desired effect) so that said contoured load bearing surface redistributes the load at the knee and ankle joints of a person wearing a shoe comprising or containing the said sole. In another embodiment the height could potentially be the same (medial to lateral and from heel to toe), but that entire span on the medial side of the sole from heel to toe could be of a softer more compressible material than the entire span from heel to toe on the lateral side of the sole that would be more firm, harder, or more rigid causing the same effect as the preferred embodiment. In this type of non-preferred embodiment when weight is applied by the foot in the shoe, the shoe sole would compress on the medial side effectively causing it to pitch into a lateral wedged position and angulation evenly from heel to toe. In yet another non-preferred embodiment separate removable wedges could be added into precut slots or spaces in the lateral side (or lateral bottom) of the shoe sole so long as the entire span of the lateral side is wedged evenly from heel to toe even allowing for various heights to be compensated evenly back to front. Lastly another non-preferred embodiment could be by use of fixed or adjustable air or gaseous bladders in the lateral side (or lateral bottom) of the shoe sole to create the same lateral wedge effect as stated throughout this specification.

These and other features, variations and advantages which characterize this invention, will be apparent to those skilled in the art, from a reading of the following detailed description and a review of the associated drawings.

Additional features and advantages of this invention will be understood from the detailed descriptions provided. This description, however, is not meant to limit the claims or embodiments, and merely serves the purpose of describing some structural claims and embodiments.

BRIEF DESCRIPTION OF THE DRAWINGS

A better understanding of the present invention will be had upon reference to the following description in conjunction with the accompanying drawings, wherein:

FIG. 1A shows the lateral wedge angle on the left shoe; FIG. 1B shows the lateral wedge angle on the right shoe; FIGS. 1C and 1D illustrate the rear view of the lateral pitch or wedge is integrated into the design of the sole of the left and right shoe, respectively. FIGS. 1E and 1F are blow-ups of the sole showing the lateral angled wedge.

FIG. 2A shows an end on view of the said sole. FIG. 2B shows a transparent perspective view of the lateral wedge sole. FIG. 2C shows a lateral side view of the said sole. The drawings in FIGS. 2A-C are only representative of the basic angles and respective proportions and are not to scale and do not represent the normal contours, curves, blunted or rounded ends, etc. of a shoe sole that would be apparent to those of ordinary skill in the art to which this sole would be integrated.

FIG. 4A shows a sandal with a sole that has a lateral wedged middle portion. FIG. 4B shows a dress shoe that has a lateral wedged middle portion. Finally, FIG. 4C shows a tennis shoe with a sole which has a lateral wedged middle portion. Also shown just below this tennis shoe is a portional or segmental diagram of the general longitudinal anatomy of the sections of the foot that are being supported and compensated by the sole of the present invention.

DETAILED DESCRIPTION OF EMBODIMENTS

Figure 1A:
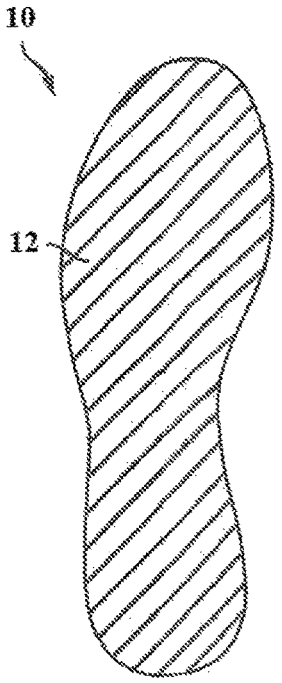
FIGS. 1A-F show different views of an embodiment of the shoe sole with a lateral pitch wedge angle spanning the length of the shoe from front to back and side to side.
Figure 1B:
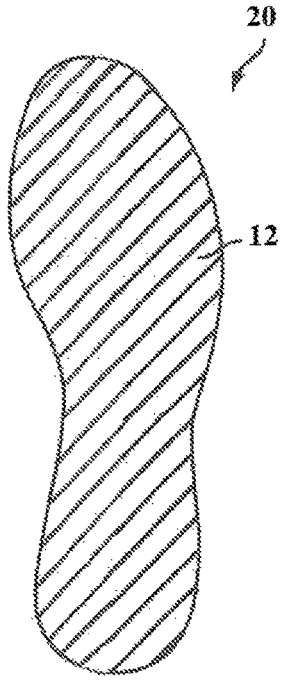
Figure 1C:
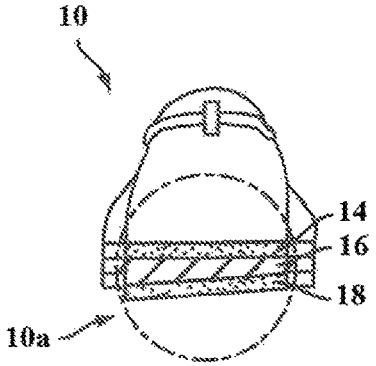
Figure 1D:
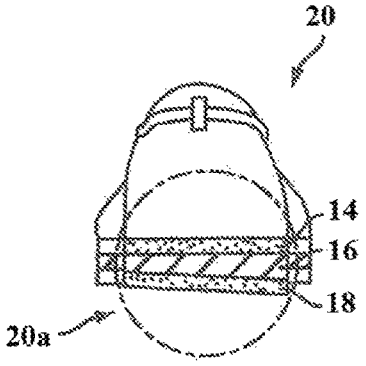
Figure 1E:
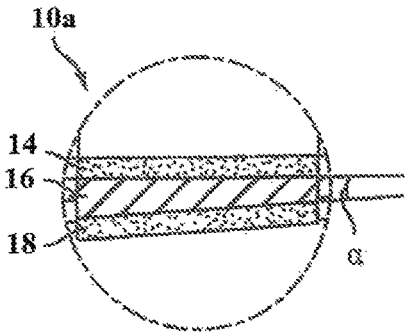
Figure 1F:
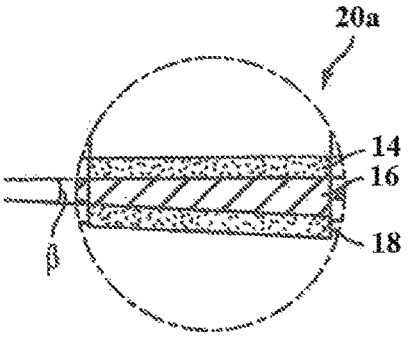
Figure 1G:
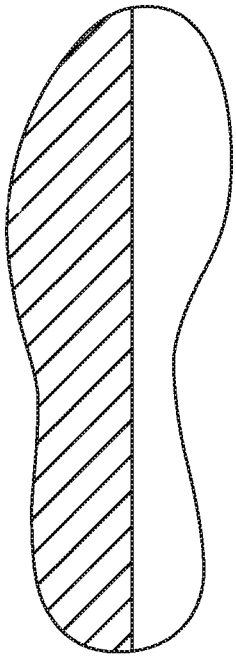
FIGS. 1G-1H are schematic diagrams of the left and right soles, respectively, showing a lateral midpoint dissecting the sole to illustrate differing pitches between the lateral and medial sides of each sole, according to an embodiment of the present invention.
Figure 1H:
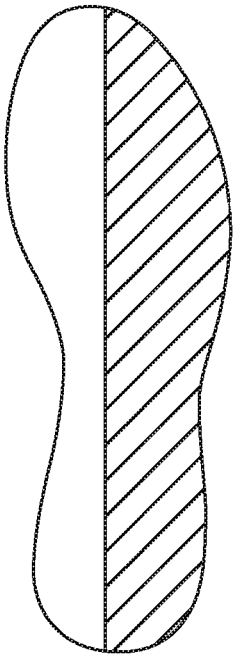

FIG. 1A shows a schematic view of the lateral wedge angle 12 on the left sole 10, while FIG. 1B shows the lateral wedge angle 12 on the right sole 20. The lateral wedge angle 12 is pointing to the lateral side of the of sole 10 and sole 20 respectively, from back to front demonstrating it is the lateral side of the sole that is of a greater height and thickness than the medial side of the sole. The slanted lines demonstrate that the lateral wedge angle 12 traverses the entire spanning length and width of the sole from back to front and side to side. FIG. 1C is an illustration of one embodiment of the invention, showing a view from the back of the shoe toward the heel. A left shoe sole 10 is shown. More clearly, FIGS. 1A-F show different views of an embodiment of the shoe sole 10 with a lateral pitch angle 12 spanning the length of the shoe from front to back and side to side. The slanted lines in the diagram illustrate the lateral wedge angle 12 of FIG. 1A and FIG. 1B are only to show that it is the lateral side of shoe sole 10 that is being compensated the most and is of a greater height and thickness than the medial side. The lateral wedge 12 in reality traverses the entire span, back to front and side to side, of the entire sole progressing in height or thickness from lesser on the medial side to greater on the lateral side. The rise begins on the medial side rising to the greater height or thickness on the lateral side. The medial side, spanning the entire length from back to front, is a lesser height or thickness than the lateral side. The greater height or thickness on the lateral side, spanning the entire length from back to front, remains at a constant height or thickness on the lateral side. The greater height or thickness on the lateral side spans the entire length from back to front on the lateral side supporting the heel, midfoot, forefoot, and toes. FIG. 1A represents the greater lateral pitch wedge angle on the left shoe; FIG. 1B represents the greater lateral pitch wedge angle on the right shoe; FIGS. 1C and 1D illustrate the rear view of the lateral pitch or wedge, showing that the lateral wedge traverses the entire span rising from the medial side to the lateral side, being of a greater height or thickness on the lateral side than on the medial side of the left and right shoe, respectively. FIGS. 1C and 1D although show a midsole being compensated, this is not meant to limit to which layer of the sole in where the lateral wedge angle is created, but rather to simply illustrate that the sole of the present invention is of a greater thickness on the lateral side compared to the lesser thickness on the medial side. It is also important to note that the lateral wedge angle 12 continues at the same height or thickness throughout the entire spanning length from back to front on the lateral side with no heel to toe longitudinal taper. The tapered angle is only medial to lateral. FIGS. 1E and 1F are blow-ups of the sole showing the lateral angled wedge previously shown in a smaller scale in FIGS. 1C and 1D; The sole comprises three basic layers; the upper or inner layer called the insole 14, the middle layer called the midsole 16, and the lower or outer layer called the outsole 18. The insole 14 meets the foot and shoe. The outsole 18 meets the walking surface and may additionally have a treaded underside that is in contact with the walking surface. The layer between the insole 14 and the outsole 18 is the midsole 16. Any of these layers independently or in combination with each other can have the lateral wedge angle 12. In the preferred embodiment, the midsole is wedged with a lateral pitch wedge angle spanning the length of the shoe from front to back and side to side. The height or thickness on the lateral side is a constant being the same spanning the entire longitudinal length from back to front on the lateral side. The entire spanning length of the lateral side is a greater height or thickness than that of the medial side from back to front. The degree of the lateral wedge angle 12 is any angle greater than zero degrees (preferably 3-7 degrees) but may vary depending on the appropriate load distribution. The lateral wedge angle 12 forms a contoured surface that redistributes the load at the knee or ankle joint of a person wearing a shoe fitted with an embodiment of the said sole 10 and or 20. The lateral wedge angle 12 can be the same degree in both the right and left shoe as it would be in the preferred embodiment however the angle can be different in either left or right shoe so long as the height and thickness of the lateral side of the sole is the same from back to front on each respective shoe sole fully supporting the entire spanning length of the lateral foot from the heel, through the midfoot, forefoot, to the toes.

Although some lateral pitching of the sole may be visible to the naked eye, it is likely that the wedge angle may be small enough so that it may be almost imperceptible to the naked eye. For this reason, a blow-up for the sole 10*a* is shown in FIG. 1E. It illustrates how the midsole 16 is wedged through an angle alpha. Again just for illustrative purposes and since it is the preferred embodiment the midsole 16 is drawn with the lateral wedge angle, however any of the sole layers can be wedged independently or in combination with one another. As is shown it is the lateral side that is of greater height and thickness than the medial side. FIGS. 1D and 1F show the corresponding features in a right shoe. FIG. 1F shows a blow-up for the sole 20*a* showing the lateral pitch angle illustrating how the midsole 16 is wedged through an angle beta. As is shown it is the lateral side that is of greater height and thickness than the medial side.

It should be noted that although in one embodiment there is an added removable lateral wedge insole, these drawings are not intended to represent a separate material bonded to or within a shoe's native sole but rather to show how the normal material in any sole itself is simply angled by this design. The lateral wedge angle is determined to counter the load bearing weight on the afflicted medial side of the knee and redistribute it to the lateral to alleviate pain, as will be explained subsequently.

In inventions of the prior art, a similar pitch is generally achieved by placing a separate insert inside the shoe on top of the shoe's native insole, or a similar pitch is achieved by attaching a separate device to the bottom of the shoe or outsole after the shoe has been manufactured. Furthermore, these laterally pitch only parts of the sole or have a bidirectional taper both medial lateral and longitudinal. One of the many disadvantages of doing this is that due to constant wear and tear, the sole loses its tread and the pitch angle is changed. Also, since the pitch may be attached to different regions of the sole, many tread designs may be incompatible with the pitch. While such arrangements of the soles and heels are not disclaimed in this invention, one of the advantages of one of the preferred embodiments of the present invention is that the pitch 12 is in the midsole 16 between the insole 14 and the lower portion 18 of the sole. Thus, the tread designs can be independent of the pitch, and the pitch angle itself will be less prone to changes due to wear and tear of the insole and outsole and will not have the safety issues associated with an external attachment. Also, the contact between the foot and the sole is at the insole 14 and thus remains unchanged. This eliminates the discomfort due to inserts that is prevalent in many shoes of the prior art. However, it should be noted that in some embodiments of this invention, the pitch may be incorporated into the outsole 18 being the tread that contacts the ground, or the insole 14 that contacts the foot. There could also be a shoe created with a sole that would have a space to accommodate the addition of separate wedges of various thickness and varying material into the midsole 16 for greater or lesser pitch or effect so long as the height or thickness on the lateral side remains the same spanning the entire longitudinal length from back to front.

In the present invention, there are no alterations or variations of durometry or hardness, or firmness of any region of the sole to achieve this angle or effect. The sole itself is of uniform consistency throughout its construction as in any normal sole design of any normal shoe with the exception of the pitch wedge angle: A normal shoe is typically level medially and laterally being parallel to the ground. In the present invention the desired angle is achieved and determined by the layer in which the pitch wedge of the sole itself is integrated. In some embodiments of this invention however, alterations or variations in hardness, or firmness of any region of the sole could be used to achieve this angle or effect.

Any individual sole layer or a combination of the layers may be pitched through an appropriate angle for the treatment of knee pain, knee joint degeneration, or knee arthritis, or ankle joint ailments. Also, it may be desirable to pitch the sole for only one foot.

Figure 2A:
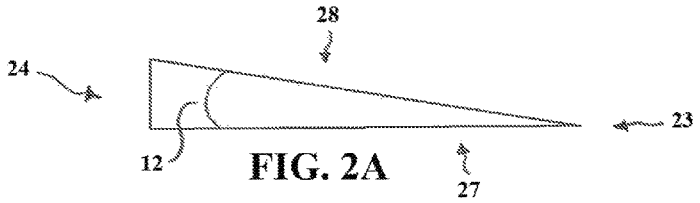
FIGS. 2A-C show different views of the compensated sole with the lateral wedge angle.
Figure 2B:
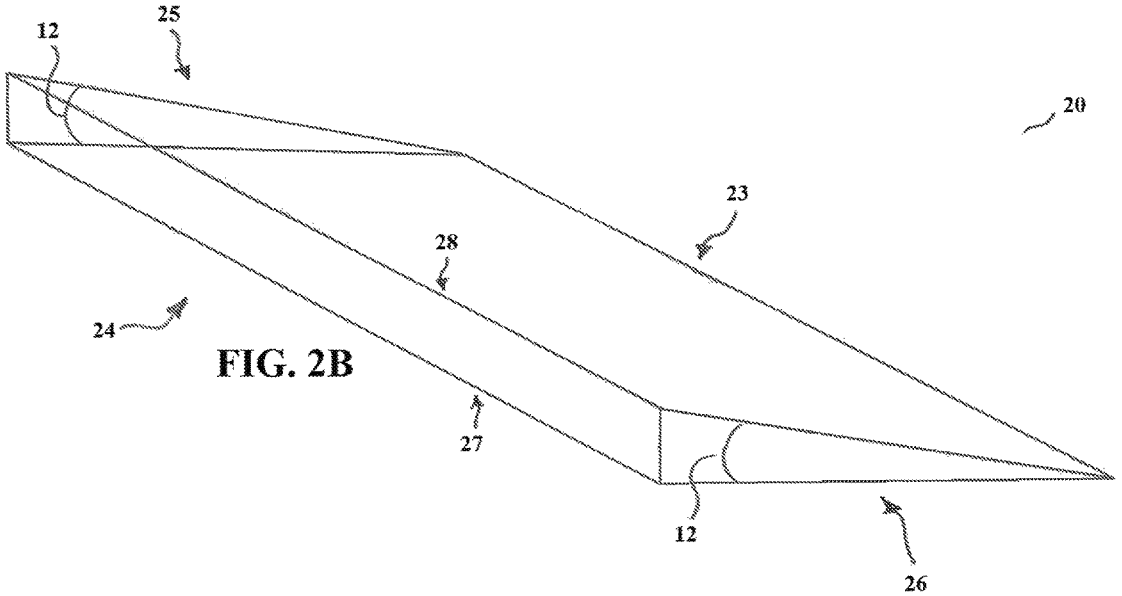
Figure 2C:
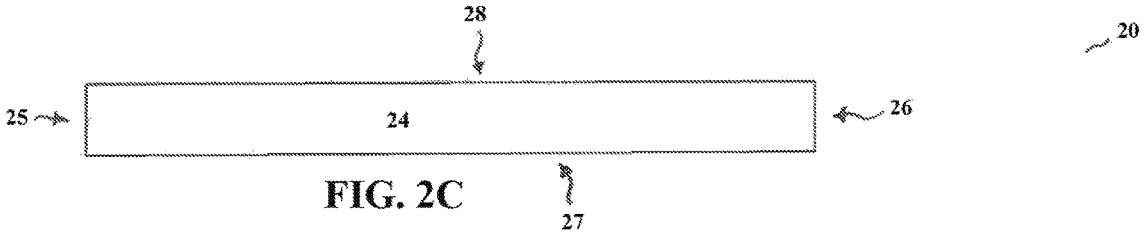

FIGS. 2A-C show different views of the compensated sole with the lateral wedge angle. FIG. 2A shows an end on view of the said sole. This view could represent an end on view from front to back of the right shoe sole 20, or an end on view from back to front of the left shoe sole 10. In either case the lateral side 24 is shown, and the medial side 23 is shown. Also shown is the bottom 27 of the lateral wedged sole which is the side towards the walking surface, and the top 28 of the lateral wedged sole that is the side towards the foot. The lateral wedge angle 12 shows where the lateral side 24 is of greater height or thickness than the medial side 23. It is important to note that the height and thickness of the lateral side 24 is the same from back to front and the medial side 23 is always of a lesser height and thickness than the lateral side 24. FIG. 2B shows a transparent perspective view of the lateral wedge sole of the right shoe sole 20. The lateral wedge angle 12 is shown spanning the entire longitudinal length from the back 25 of the sole 20 to the front 26 of the sole 20. The greater height and thickness is shown on the lateral side 24, and the lesser height and thickness is shown on the medial side 23. FIG. 2B could also represent a transparent perspective view of the lateral wedge sole of the left shoe sole 10 if the back 25 and front 26 were reversed. Also shown is the bottom 27 of the lateral wedge sole 20 which is the side towards the walking surface, and the top 28 of the lateral wedged sole 20 that is the side towards the foot. FIG. 2C shows a lateral side 24 view of the lateral wedged sole of right shoe sole 20 facing the lateral side 24 straight on. Again the back 25 of the shoe sole 20 and the front 26 of the shoe sole 20 are shown. FIG. 2C could also represent a lateral side 24 view of the left shoe sole 10 facing the lateral side 24 straight on if the back 25 and the front 26 were reversed. Note again here that the height and thickness of the lateral side 24 is the same spanning the entire longitudinal length from back 25 to front 26. Also shown is the bottom 27 of the lateral wedged sole 20 which is the side towards the walking surface, and the top 28 of the lateral wedged sole 20 that is the side towards the foot. The drawings in FIGS. 2A-C are only representative of the basic angles and respective proportions and are not to scale and do not represent the normal contours, curves, blunted or rounded ends, etc. of a shoe sole that would be apparent to those of ordinary skill in the art to which this sole would be integrated.

Figure 1I:
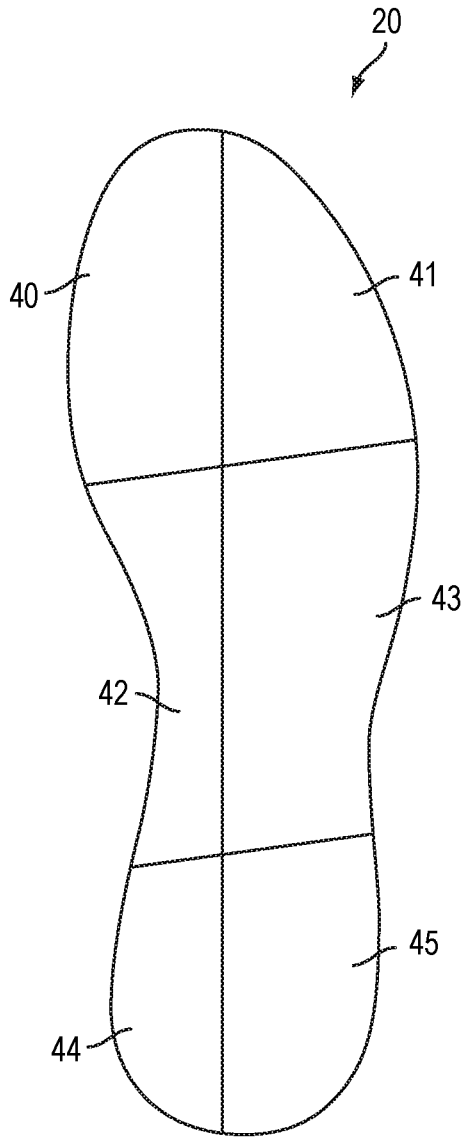
FIG. 1I is a schematic diagram of the right sole illustrating different regions of the sole that may be pitched to redistribute a user 's weight.

FIG. 1I is a schematic diagram of the right sole 20 showing different regions that may be pitched due to the therapeutic needs of an individual. In an embodiment, there are six distinct regions 40, 41,42, 43, 44, and 45. Other regions, of varying shapes and sizes, may be formed on any part of the sole to achieve a desired wedge angle or effect. Any individual region or a combination of regions may be pitched through an appropriate angle for the treatment of knee pain, knee joint degeneration, or knee arthritis, or ankle joint ailments. Also, it may be desirable to pitch the sole or the heel for only one foot, or pitch different regions of the sole or heel for each foot. It may also be desirable to pitch the sole on one foot and the heel on the other foot, or pitch both the sole and the heel on both feet By choosing the regions, angled regions, and the shapes and angles of the wedges, the contoured load hearing surface may he configured to redistribute the load at the knee or ankle joint of a person wearing a shoe comprising the sole or heel of this invention, or a combination of both, for the purposes of treating ailments in the knee, to slow the progression of degenerative joint disease in the knee, or to improve athletic or ambulatory performance during lateral cutting, lateral cornering, or lateral push off, or to decrease risk of ankle eversion or inversion injuries.

Figure 3A:
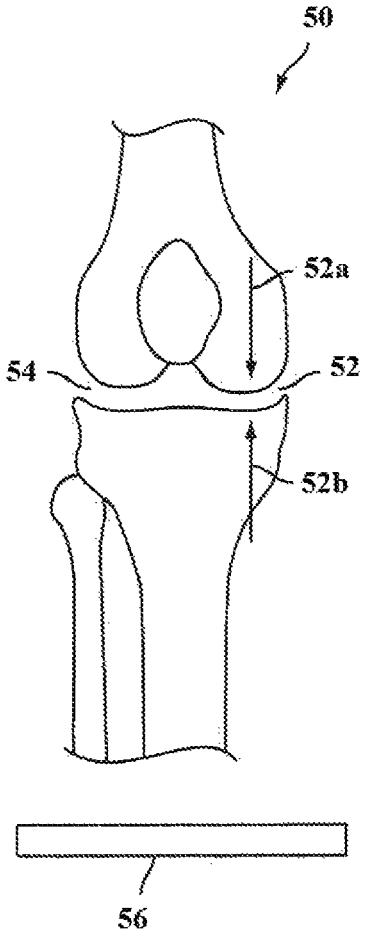
FIG. 3A is the frontal-view of a right knee with medial knee arthritis. The figure illustrates where the increased load is distributed on the medial joint compartment compared to the decreased or lesser load on the lateral joint compartment from a weight bearing level surface.
Figure 3B:
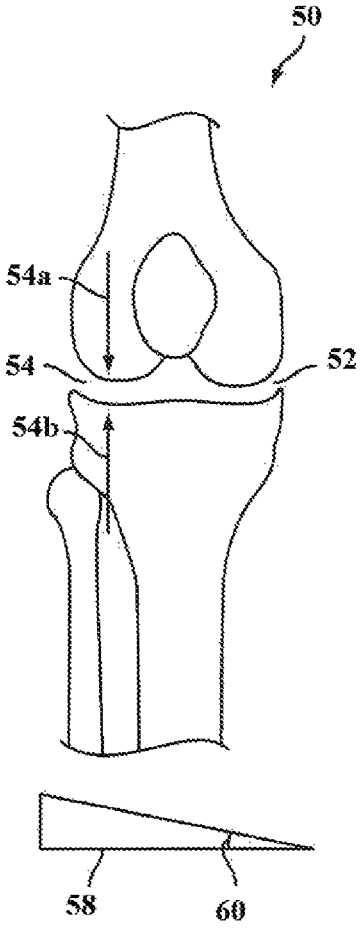
FIG. 3B illustrates how this load is redistributed in part to the lateral side of the knee in effect decreasing the problematic load on the medial side of the knee when standing on a weight bearing surface with a lateral pitch or wedge angle. The same would be true for its counterpart of a knee with lateral compartment arthritis if standing on a weight bearing surface with a medial pitch or wedge angle.

FIGS. 3A and 3B are frontal views of the right knee 50 with medial knee arthritis, where the afflicted region is generally shown on the medial side 52. Referring to FIG. 3A, when a normal person with no medial knee arthritis stands on a weight bearing level surface 56, the load is equally distributed over the medial side 52 and the lateral side 54. However, when medial knee arthritis is present, then the load is borne largely by the medial side 52 which will also be true prior to development of arthritis in a person with a congenital varus (bow leg) knee deformity. This increased medial load is illustrated by the two vectors 52*a* and 52*b*. Vector 52*a* represents the weight of the body, whereas vector 52*b* represents the opposite force acting from the weight bearing surface. FIG. 3B shows the effect of lateral pitching on the load bearing ability of this same afflicted knee with medial compartment arthritis. The figure shows a weight bearing surface with a laterally wedge angled pitch 58. When a person with medial knee arthritis stands or walks on such a weight bearing surface, the load on the medial side 52 of the knee is redistributed in part to the lateral side 54. This is shown by the vector 54*a* which represents the weight of the body, whereas vector 54*b* represents the opposite force acting from the laterally pitched weight bearing surface. Such a redistribution of the load takes the stress off the afflicted medial side 52, thereby alleviating the pain, and in some instances, slows the progressing of degeneration. The pitch angle 60 is chosen to counter the load on the medial side. This may depend on several factors, including, but not limited to, the extent of the disease, the strength of the muscles, the shape of the leg, and the type of shoe while still being universal to the general population. It is important to note here that this laterally pitched weight bearing surface 58 is at the same height and thickness from the entire longitudinal spanning length back to front on the lateral side, which is exactly representing the laterally pitched sole of the present invention. There is no taper down or up from the heel to the toe on the lateral side as it is in the prior art.

Figure 4A:
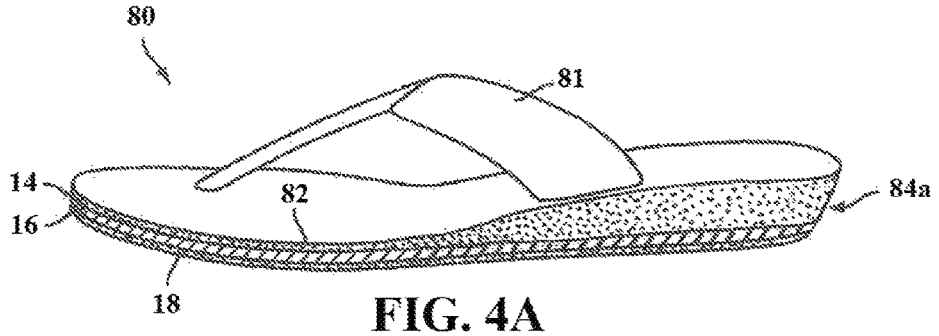
FIGS. 4A-C show various embodiments of combinations of a shoe with a sole as described in this invention.
Figure 4B:
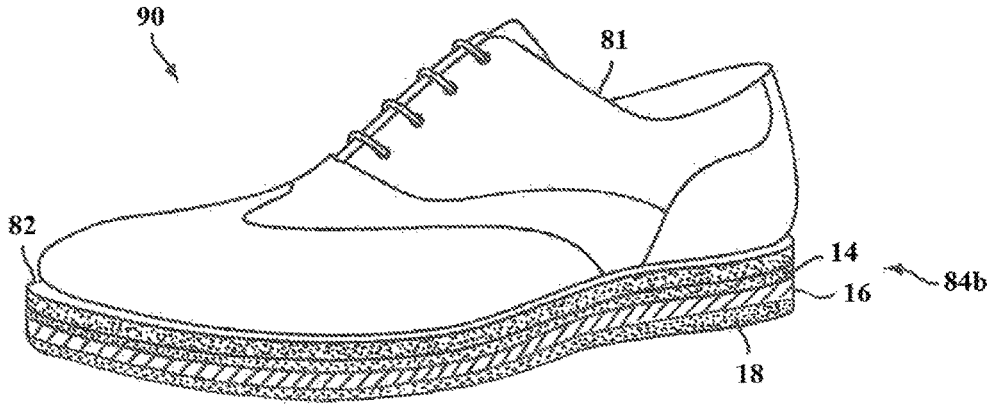
Figure 4C:
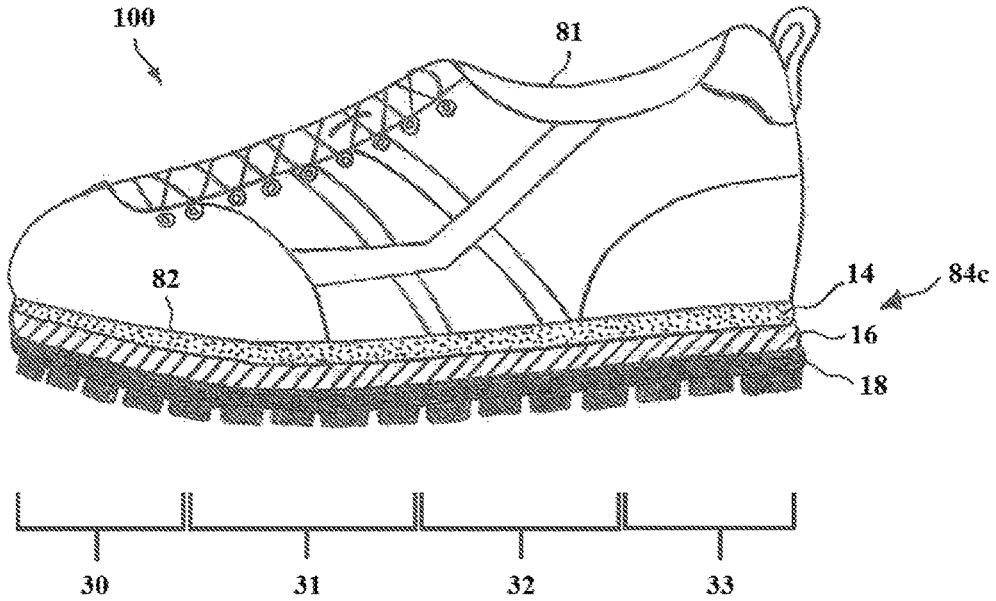

FIGS. 4A-C illustrate lateral side views of different shoes with the embodiments of this invention. The shoes drawn here should be understood not to limit the types of shoes that can be used but rather just shows some of the types for illustrative purposes. The sole of the present invention can be universally applicable to any type of shoe footwear (the preferred embodiment being an athletic type tennis shoe.) FIG. 4A shows a lateral view of a left sandal 80, with a shoe interior 81 and an undersurface 82. The sole 84*a* is in contact with the undersurface 82. In this particular embodiment, the sole comprises three layers, the insole 14, the outsole 18, and the midsole 16. The midsole 16 is illustrated as being laterally wedged, in this particular embodiment. Note that the height and thickness on the lateral side is the same from heel to toe with no heel to toe longitudinal taper. Also note that the wedged midsole 16 is represented here but in other embodiments the wedge may be of any layer of the sole independently or in combination with any other layer including the insole 14, or the outsole 18.

FIG. 4B shows a lateral view of a left dress shoe 90, with a shoe interior 81 and an undersurface 82. A sole 84*b* is in contact with the undersurface 82. In this particular embodiment, the sole comprises three layers, the insole 14, the outsole 18, and the midsole 16. The midsole 16 is illustrated as being wedged, in this particular embodiment. Note that the height and thickness on the lateral side is the same from heel to toe with no heel to toe longitudinal taper.

FIG. 4C shows a lateral view of a left tennis shoe 100, with a shoe interior 81 and an undersurface 82. A sole 84*c* is in contact with the undersurface 82. In this embodiment, the sole comprises of three layers, the insole 14, the outsole 18, and the midsole 16. The midsole 16 is illustrated as being wedged, in this particular embodiment. Note that the height and thickness on the lateral side is the same from heel to toe with no heel to toe longitudinal taper still while following the contour of the shoe. Also shown just below this lateral view of a left tennis shoe is a portional or segmental diagram 30-33 of the general longitudinal anatomy of the lateral sections of the foot that are supported and compensated evenly (back to front) by the lateral wedged sole of the present invention. Portion 30 shows the lateral toes section of the foot, portion 31 shows the lateral forefoot section of the foot, portion 32 shows the lateral midfoot section of the foot, and portion 33 shows the lateral heel portion of the foot.

Although a few embodiments of a laterally wedged shoe sole are illustrated here, it should be apparent to a person of ordinary skill that other shapes, geometries, and materials will also be compatible with different designs of the sole, and the shoe, consistent with the shape required for a contoured load bearing surface. Although a few different types of shoes are shown here, it should be apparent to a person of ordinary skill that this sole can be integrated into any type of shoe, sandal, flip flop, clog, boot, or other type of footwear.

By choosing the layers and angles of the wedge/s, the contoured load bearing surface may be configured to redistribute the load at the knee or ankle joint of a person wearing a shoe comprising or containing the sole of this invention, or a combination of both, for the purposes of treating ailments in the knee, to slow the progression of degenerative joint disease in the knee, or to improve athletic or ambulatory performance during lateral cutting, lateral cornering, or lateral push off, or to decrease risk of ankle inversion injuries.

Although the preceding discussion was about medial knee arthritis in the right knee, it should be apparent that a similar description applies to the left knee as well. Additionally, it should be apparent to those skilled in the art that the sole may be suitably adjusted to alleviate suffering in ankle joints as well, or to enhance or improved ambulatory or athletic performance as described herein.

In this specification, the layers of the sole have been described separately, however, it should be noted that there may be various layers to the sole in some types of shoes, or there may only be one composite entity or layer to the sole in other types of shoes. In particular, all the angled layers may be integrated into the sole during the manufacturing process itself containing various materials, or it may be a single uni-body sole made of generally the same material.

It should be apparent to those skilled in the art that the sole and the shoe itself may be of any color, texture, or combinations thereof. Similarly, the shoe may be of any type or style, including, but not limited to, shoes with or without heels, open or closed back shoes, tennis shoes, dress shoes, running shoes, walking shoes, hiking shoes, men's or women's shoes, sandals, flip flops, clogs, boots, house shoes etc. The soles of the present invention may be designed into the fabrication of any such shoe and any and all footwear including even socks or stockings with wedged grips.

While many novel features have been described above, the invention is not that that those skilled in the art may understand all other embodiments that may arise due to modifications, omissions and substitutions of these embodiments that are still nonetheless within the scope of this invention.

I claim:

1. A sole for footwear, wherein an outer edge of a lateral side of the sole has a uniform height and thickness extending from a rear of the sole to a front of the sole, and wherein an outer edge of a medial side of the sole has a non-uniform height and thickness extending from the rear of the sole to the front of the sole, wherein a top of the entire sole is upwardly sloped from the outer edge of the medial side to the outer edge of the lateral side, wherein the sole has a shape adapted to extend under an entire wearer's foot.

2. The sole of claim 1, wherein a height and thickness of a portion of the outer edge of the medial side extending between the front of the sole and the rear of the sole is greater than the posterior height and thickness of the outer edge of the medial side.

3. The sole of claim 2, wherein a pitch of the top of the sole extending from the outer edge of the medial side to the outer edge of the lateral side, and corresponding to the portion of the outer edge of the medial side having greater thickness, is constant.

4. The sole of claim 1, wherein a lateral pitch of a top of the sole is different than a medial pitch of the top of the sole, wherein the lateral pitch extends from the outer edge of the lateral side to a lateral midpoint of the sole, and wherein the medial pitch extends from the lateral midpoint of the sole to the outer edge of the medial side.

5. The sole of claim 4, wherein a height and thickness of a portion of the outer edge of the medial side extending between the front of the sole and the rear of the sole is greater than the posterior height and thickness of the outer edge of the medial side and the anterior height and thickness of the outer edge of the medial side.

6. The sole of claim 5, wherein a pitch of the top of the sole extending from the outer edge of the medial side to the outer edge of the lateral side, and corresponding to the portion of the outer edge of the medial side having an increased thickness, is constant.

* * * * *